US007355565B2

(12) United States Patent
Kim et al.

(10) Patent No.: US 7,355,565 B2
(45) Date of Patent: Apr. 8, 2008

(54) PLASMA DISPLAY PANEL DRIVING METHOD

(75) Inventors: Jin-Sung Kim, Suwon-si (KR); Woo-Joon Chung, Suwon-si (KR); Seung-Hun Chae, Suwon-si (KR); Kyoung-Ho Kang, Suwon-si (KR); Tae-Seong Kim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 587 days.

(21) Appl. No.: 10/974,946

(22) Filed: Oct. 28, 2004

(65) Prior Publication Data

US 2005/0093779 A1 May 5, 2005

(30) Foreign Application Priority Data

Oct. 29, 2003 (KR) ..... 10-2003-0075930

(51) Int. Cl.
*G09G 3/28* (2006.01)

(52) U.S. Cl. ..... 345/60; 345/63

(58) Field of Classification Search ..... 345/60–68; 313/581–586; 315/169.3
See application file for complete search history.

(56) References Cited

U.S. PATENT DOCUMENTS

| | | | | |
|---|---|---|---|---|
| 4,866,349 | A | 9/1989 | Weber et al. | 315/169.4 |
| 5,081,400 | A | 1/1992 | Weber et al. | 315/169.4 |
| 6,608,447 | B2 * | 8/2003 | Ahn | 315/169.1 |
| 7,164,395 | B2 * | 1/2007 | Myoung et al. | 345/60 |
| 2003/0080925 | A1 | 5/2003 | Lee | 345/60 |

FOREIGN PATENT DOCUMENTS

| | | |
|---|---|---|
| JP | 06-076744 | 3/1994 |
| JP | 06-314078 | 11/1994 |
| JP | 07-261699 | 10/1995 |
| JP | 08-123362 | 5/1996 |
| JP | 08-320669 | 12/1996 |
| JP | 08320669 | 12/1996 |
| JP | 10171399 | 6/1998 |
| JP | 10-207420 | 8/1998 |
| JP | 11-338417 | 12/1999 |
| JP | 2001-005422 | 1/2001 |
| JP | 2003-029700 | 1/2003 |
| KR | 1020010090945 | 10/2001 |
| KR | 10-2003-0006885 | 1/2003 |
| KR | 1020040025010 | 3/2004 |

* cited by examiner

*Primary Examiner*—Nitin I. Patel
(74) *Attorney, Agent, or Firm*—H.C. Park & Associates, PLC

(57) ABSTRACT

A method for driving a display panel including a first electrode, a second electrode and an address electrode crossed with the first and second electrodes to form a discharge cell. The method comprises, during a sustain period, alternately applying a voltage pulse to the first and second electrodes, and floating the first or the second electrode and maintaining it at a first voltage level while the voltage pulse is applied to the other electrode.

20 Claims, 3 Drawing Sheets

PLASMA DISPLAY PANEL DRIVING METHOD

CROSS REFERENCE TO RELATED APPLICATION

This application claims priority to and the benefit of Korean Patent Application No. 10-2003-0075930, filed on Oct. 29, 2003, which is hereby incorporated by reference for all purposes as if fully set forth herein.

BACKGROUND OF THE INVENTION

1. Field of the Invention

The present invention relates to a display panel. More specifically, the present invention relates to a driving method for a plasma display panel (PDP) that increases the panel's efficiency.

2. Discussion of the Related Art

The PDP is a flat display that uses plasma generated via a gas discharge process to display characters or images, and tens of thousands to millions of pixels are provided thereon in a matrix format, depending on its size. PDPs are categorized into direct current (DC) PDPs and alternating current (AC) PDPs, according to supplied driving voltage waveforms and discharge cell structures.

FIG. 1 shows a perspective view of a conventional AC PDP.

As shown, a parallel pair of a scan electrode 4 and a sustain electrode 5, covered by a dielectric layer 2 and a protection film 3, are provided under a first glass substrate 1. A plurality of address electrodes 8, covered with an insulation layer 7, is formed on a second glass substrate 6. Barrier ribs 9 are formed in parallel with, and in between, the address electrodes 8, and phosphor 10 is formed on the insulation layer 7 and the sides of the barrier ribs 9. The first and second glass substrates 1 and 6 having a discharge space 11 between them are sealed together so that the scan electrode 4 and the sustain electrode 5 are orthogonal to the address electrode 8. A portion of the discharge space 11 where an address electrode 8 crosses the pair of the scan electrode 4 and the sustain electrode 5 forms a discharge cell 12.

FIG. 2 shows a typical PDP electrode arrangement.

As shown, the PDP electrodes are arranged in an m×n matrix configuration. Address electrodes $A_1$ to $A_m$ are arranged in the column direction, and scan electrodes $Y_1$ to $Y_n$ and sustain electrodes $X_1$ to $X_n$ are alternately arranged in the row direction. The discharge cell 12 corresponds to the discharge cell 12 of FIG. 1.

FIG. 3 shows a conventional PDP driving waveform.

As shown, each subfield has a reset period, an address period, and a sustain period according to a conventional PDP driving method.

In the reset period, wall charges formed by a previous sustain discharge are is erased, and states of the cells are reset so as to fluently perform a next address operation. In the address period, panel cells which are to be turned on are selected, and wall charges accumulate on the turned-on cells (addressed cells.) In the sustain period, a discharge for displaying images on the addressed cells is performed by alternately applying sustain pulses to the X and Y electrodes. Conventionally, one strong sustain discharge may be generated for each sustain pulse by applying the sustain pulse to the X or Y electrode while maintaining the other electrode at a ground voltage level. The strong sustain discharge may generate excessive priming particles, which may not be used in a subsequent operation, thereby degrading the PDP's efficiency.

SUMMARY OF THE INVENTION

The present invention provides increased PDP efficiency and reduced power consumption by reducing and reusing priming particles that are generated at the time of a sustain discharge.

Additional features of the invention will be set forth in the description which follows, and in part will be apparent from the description, or may be learned by practice of the invention.

The present invention discloses a method for driving a display panel having a first electrode and a second electrode formed in parallel on a first substrate, and an address electrode crossed with the first electrode and the second electrode and formed on a second substrate. The method comprises alternately applying a voltage pulse to the first and second electrodes during a sustain period, and floating the first electrode or the second electrode and maintaining it at a first voltage level while the voltage pulse is applied to the other of the first and second electrode.

The present invention also discloses a PDP comprising first and second substrates, first and second electrodes formed in parallel on the first substrate, and an address electrode formed on the second substrate. A driving circuit generates driving signals to the first, second, and address electrodes during an address period and a sustain discharge period. During the sustain period, the driving circuit alternately applies a voltage pulse to the first and second electrodes, and floats one of the first or second electrodes and maintains it at a first voltage level while the voltage pulse is applied to the other electrode.

The present invention also discloses a method for sustain discharging a discharge cell formed by a first electrode, a second electrode, and an address electrode crossed with the first electrode and the second electrode. The method comprises applying a first voltage pulse to the first electrode, and while applying the first voltage pulse to the first electrode, floating the second electrode and then maintaining a first voltage level at the second electrode.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENTS

Figure 1:
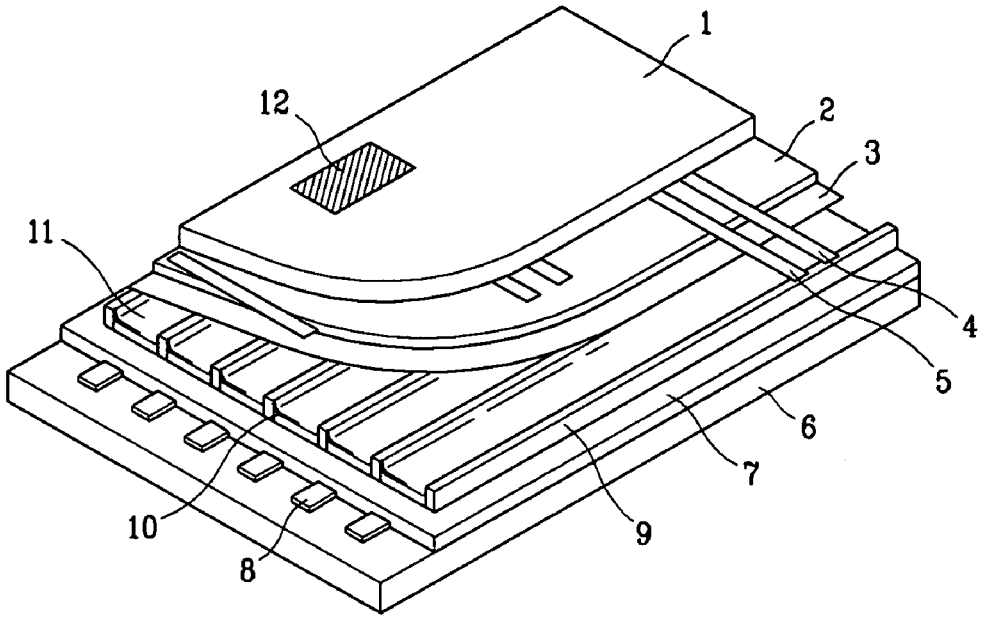
FIG.1(Prior Art)
FIG. 1 is a partial perspective view showing a conventional AC PDP.
Figure 2:
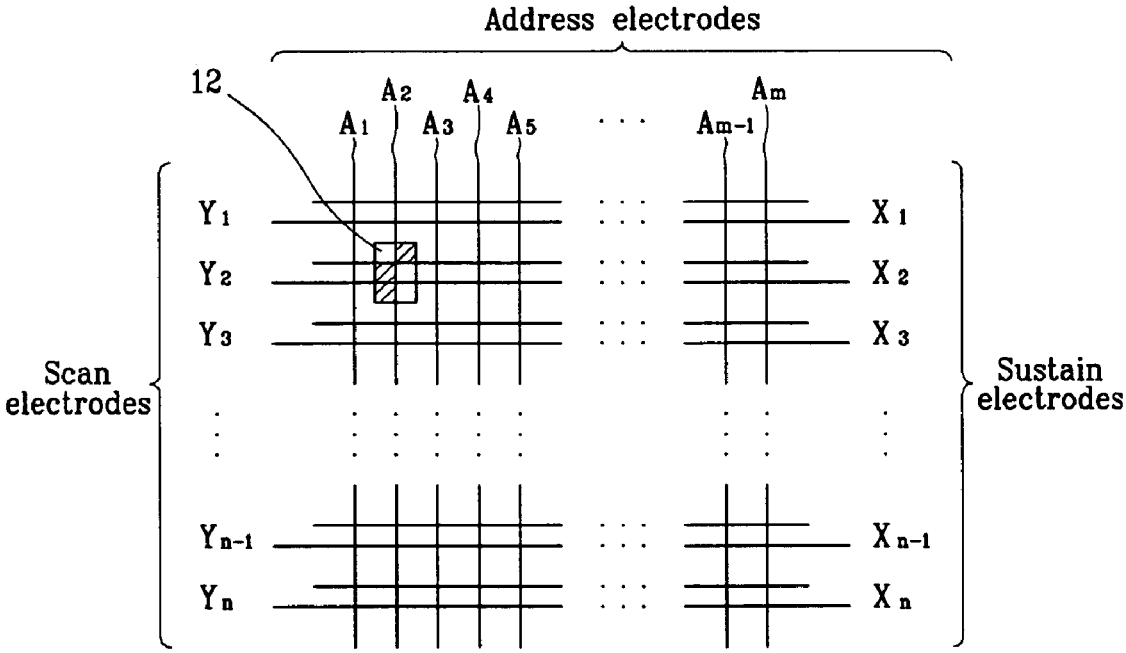
FIG.2(Prior Art)
FIG. 2 shows a typical PDP electrode arrangement.
Figure 3:
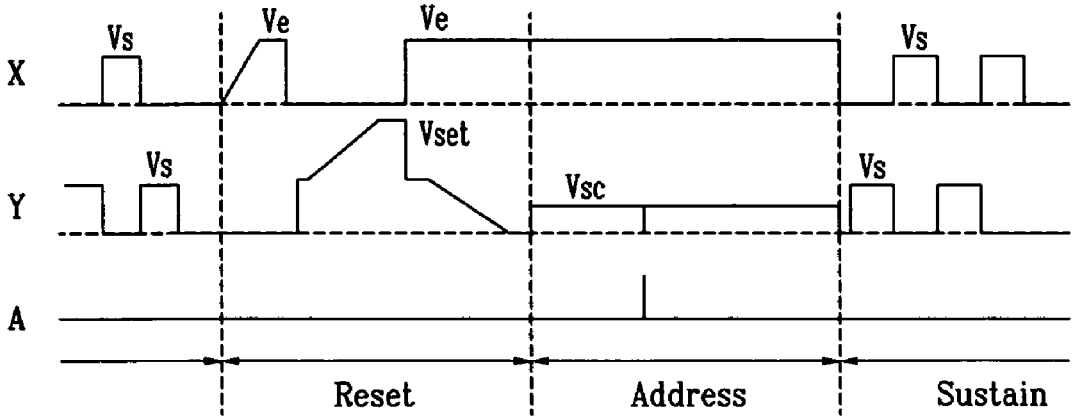
FIG.3(Prior Art)
FIG. 3 shows a conventional PDP driving waveform.

The following detailed description shows and describes exemplary embodiments of the invention, simply by illustrating the best mode contemplated by the inventors of carrying out the invention. As will be realized, the invention is capable of modification in various obvious respects, all without departing from the invention. Accordingly, the drawings and description are to be regarded as illustrative in nature, and not restrictive. To clarify the present invention, parts which are not described in the specification are omitted, and parts for which similar descriptions are provided have the same reference numerals.

As described below, wall charges represent charges that are formed on a wall (e.g., a dielectric layer) of a discharge cell near the electrodes. The wall charges do not actually contact the electrodes, but they are described to be "formed," "charged," or "accumulated" on the electrodes. A wall voltage indicates a potential difference formed on the wall of the discharge cells according to wall charges.

Figure 4:
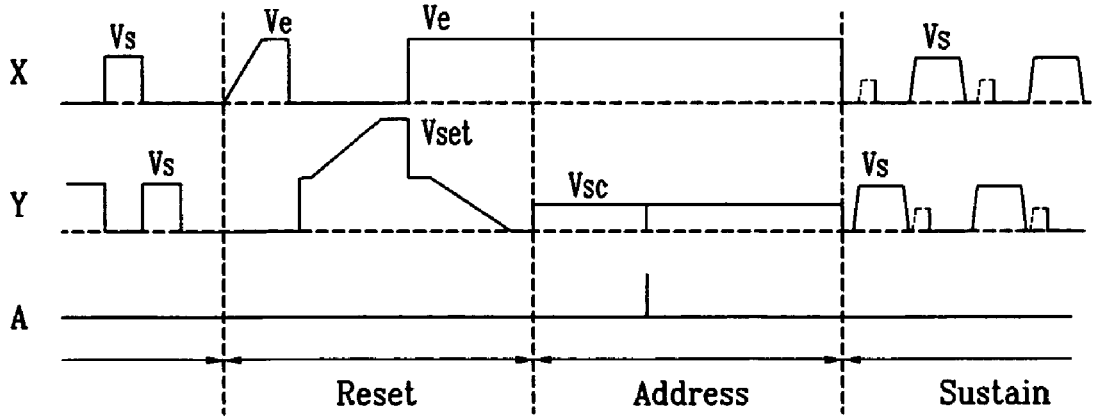
FIG. 4 shows a PDP driving waveform according to an exemplary embodiment of the present invention.

FIG. 4 shows a PDP driving waveform diagram according to an exemplary embodiment of the present invention.

As shown, one subfield comprises a reset period, an address period, and a sustain period.

In the sustain period according to an exemplary embodiment of the present invention, sustain pulses are alternately applied to the X and Y electrodes, and the electrode to which no sustain pulse is applied from among the X and Y electrodes is floated and maintained is at a low voltage level. In other words, when the sustain pulse is applied to an X electrode, a Y electrode is floated and maintained at a low voltage level. Next, the sustain pulse is applied to the Y electrode, and the X electrode is floated and maintained at a low voltage level. This process may continue throughout the sustain period.

FIG. 4 shows a sustain pulse having a voltage of $V_s$ being applied to an X electrode while a Y electrode is floated and maintained at 0V, and a sustain pulse having a voltage of $V_s$ being applied to the Y electrode while the X electrode is floated and maintained at 0V. The voltage of $V_s$ is a voltage level that generates a sustain discharge at an addressed cell.

Figure 5:
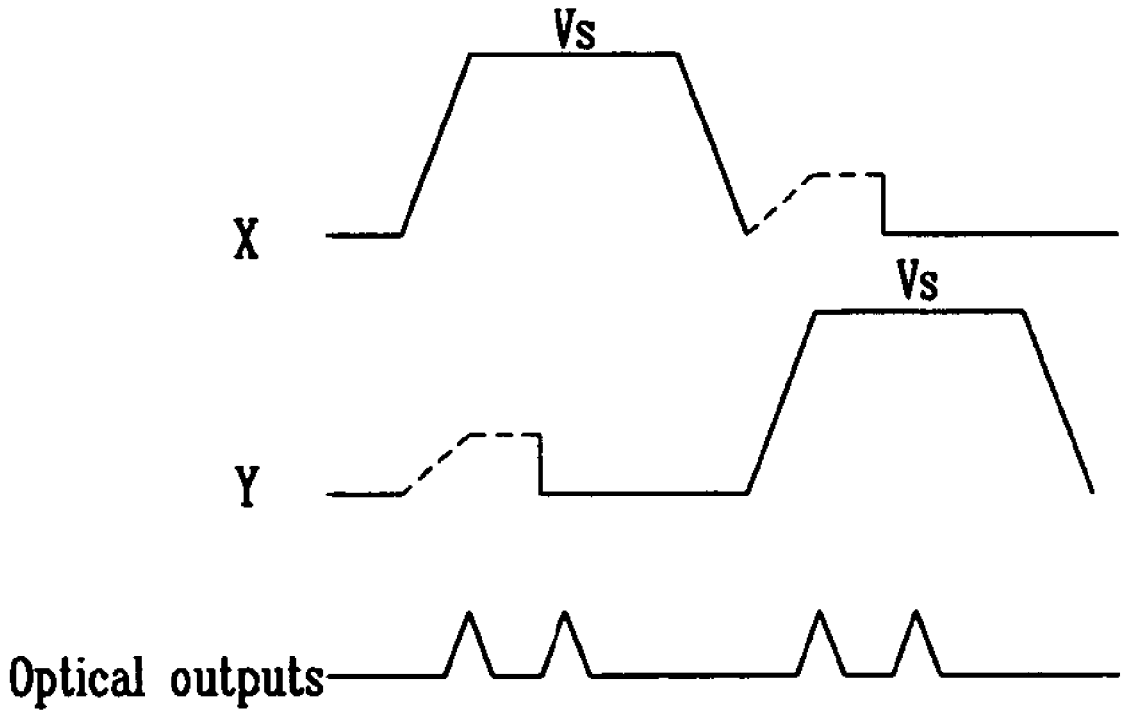
FIG. 5 shows a magnified diagram of part of a sustain period in the PDP driving waveform of FIG. 4.

FIG. 5 shows a magnified diagram of part of a sustain period in the PDP driving waveform shown in FIG. 4.

As shown, the sustain pulse having a voltage of $V_s$ is applied to the X electrode, and the Y electrode may be floated before the sustain pulse generates a discharge. Generally, when the sustain pulse is applied to the X or Y electrode, a power recovery circuit, which may use resonance between an inductor and a capacitance component, may be formed on the discharge cell in order to reuse the reactive power, as disclosed in U.S. Pat. No. 4,866,349, U.S. Pat. No. 5,081,400 and U.S. Patent Application No. 2003-0080925. When using a power recovery circuit, the sustain pulse may increase from 0V to the voltage of $V_s$ with a predetermined gradient.

Since capacitance components are formed between the X, Y, and A electrodes, when the voltage at the X electrode increases from 0V to the voltage of Vs, the voltage at the floated Y electrode also increases, but it increases at a slower rate than at the X electrode because the address electrode A maintains a constant voltage.

Therefore, the voltage difference between the X and Y electrodes gradually increases, and when that voltage difference combines with a wall voltage to exceed a discharge firing voltage, a first discharge may be generated.

As shown in FIG. 5, the period for floating the Y electrode may include a whole rising interval of the sustain pulse. In addition, the Y electrode can be floated at a time before a sustain discharge is generated because of the rise of the voltage at the X electrode, or at a time which does not exceed 50% of the whole discharge when the sustain discharge is generated, without floating the Y electrode at the rising start time of the voltage at the X electrode. Accordingly, the Y electrode is floated while the voltage at the X electrode increases.

When 0V is applied to the Y electrode after it is floated, the voltage difference between the X and Y electrodes quickly increases. In this instance, the voltage difference between the X and Y electrodes exceeds the discharge firing voltage, and a second discharge is generated in the discharge cell.

Once an electrode is floated, it is desirable to apply the low voltage to that electrode within 1 μs of the first sustain discharge's termination. The resonance of the above-described power recovery circuit may be used to reduce the voltage at the floated electrode to 0V.

The sustain discharge may be consecutively performed by repeating the process of alternately applying the sustain pulse to the X and Y electrode, floating the electrode to which no sustain pulse is applied, and modifying the voltage of the floated electrode to a lower voltage.

Accordingly, two discharges may be generated by floating a first electrode and then maintaining a low voltage level at the first electrode while applying a sustain pulse to a second electrode. Since both discharges generated in this time may be weak, less priming charges may be generated as compared to the prior art, and the priming charges generated in the is first discharge may be used for the second discharge, thereby providing better PDP efficiency.

According to the present invention, the starting time for floating the electrode to which no sustain pulse is applied may differ depending on a load of the panel.

That is, when a lesser load is provided to the panel because fewer cells need to be turned on, voltage variation of the opposite electrode may lessen because of floating, and a large first discharge and no second discharge may be generated. Therefore, when the sustain pulse is applied to the X electrode, the potential difference between the X and Y electrodes may be effectively reduced by floating the Y electrode in an earlier stage.

On the other hand, when a greater load is provided to the panel because more cells need to be turned on, voltage variation of the opposite electrode increases because of floating, and a weak first discharge may be generated. Therefore, when the sustain pulse is applied to the X electrode, it may be desirable to float the Y electrode after a predetermined time has passed in order to prevent deviation of discharge intensity caused by the load.

In this instance, the load is found by the ratio of turned-on cells of each subfield to the total number of discharge cells. That is, the load is found by finding the cells which are turned on in each subfield, and by finding the ratio of the turned-on discharge cells to the total of discharge cells. Another method for finding the load is achieved by finding the average signal level per frame, that is, by finding the average of gray scales applied to the total of discharge cells in a frame, which will no further be described in detail since it is well known to a person skilled in the art.

While it is described above that the sustain discharge pulse is applied to the X electrode, and a low voltage is applied after the Y electrode being floated, it is obvious to a person skilled in the art that two discharges may also be generated by applying the sustain discharge pulse to the Y electrode, and floating the X electrode and maintaining it at a low voltage, and a first strong discharge and a second weak discharge may be generated depending on exemplary embodiments.

According to an exemplary embodiment of the present invention, lesser priming charges may be generated because the second weak discharge is generated instead of a first strong discharge. Further, power consumption may be reduced by 15% since the priming charges generated in the first discharge may be used for the second discharge.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A plasma display panel (PDP), comprising:

a first substrate and a second substrate;

a first electrode and a second electrode formed in parallel on the first substrate;

an address electrode formed on the second substrate; and a driving circuit for generating driving signals to the first electrode, the second electrode, and the address electrode during an address period and a sustain discharge period, wherein the driving circuit, during the sustain period, alternately applies a voltage pulse to the first electrode and the second electrode, and floats the first electrode or the second electrode and maintains the floated electrode at a first voltage level while applying the voltage pulse to another of the first electrode and the second electrode.

2. The PDP of claim 1, wherein, during the sustain period, the driving circuit maintains the address electrode at a second voltage level.

3. The PDP of claim 1, wherein a time that an electrode is floated depends on a load of the PDP.

4. The PDP of claim 1, wherein an electrode is floated before the voltage pulse is applied.

5. The PDP of claim 1, wherein an electrode is floated after the voltage pulse is applied.

6. A method for driving a display panel having a first electrode and a second electrode formed in parallel on a first substrate, and an address electrode crossing the first electrode and the second electrode and formed on a second substrate, the method comprising:

during a sustain period, alternately applying a voltage pulse to the first electrode and the second electrode; and floating the first electrode or the second electrode and maintaining the floated electrode at a first voltage level while applying the voltage pulse to another of the first electrode and the second electrode.

7. The method of claim 6, wherein the floated electrode is floated during a rising period of the voltage pulse.

8. The method of claim 6, wherein a time that an electrode is floated depends on a load of the display panel.

9. The method of claim 6, wherein an electrode is floated before applying the voltage pulse.

10. The method of claim 6, wherein an electrode is floated after applying the voltage pulse.

11. The method of claim 6, wherein the first voltage level is applied to the floated electrode within 1 μs after a sustain discharge ends.

12. The method of claim 6, wherein the first voltage level is applied to the floated electrode through resonance with an inductor.

13. The method of claim 6, wherein the address electrode is maintained at a ground voltage level.

14. A method for sustain discharging a discharge cell formed by a first electrode, a second electrode, and an address electrode crossing with the first electrode and the second electrode, the method comprising:

applying a first voltage pulse to the first electrode; and while applying the first voltage pulse to the first electrode, floating the second electrode and then maintaining a first voltage level at the second electrode.

15. The method of claim 14, further comprising:

applying a second voltage pulse to the second electrode after applying the first voltage pulse to the first electrode; and while applying the second voltage pulse to the second electrode, floating the first electrode and then maintaining the first voltage level at the first electrode.

16. The method of claim 14, wherein the second electrode is floated during a rising period of the first voltage pulse.

17. The method of claim 14, wherein an amount of time that the second electrode is floated depends on a number of discharge cells that are turned on.

18. The method of claim 14, wherein the second electrode is floated before applying the first voltage pulse to the first electrode.

19. The method of claim 14, wherein the second electrode is floated after applying the first voltage pulse to the first electrode.

20. The method of claim 14, wherein the first voltage level is applied to the second electrode within 1 μs after a sustain discharge ends.

* * * * *